United States Patent [19]

Bourgeois

[11] 4,055,968

[45] Nov. 1, 1977

[54] DRIVE ARRANGEMENT FOR WIND-UP APPARATUS IN A CIRCULAR KNITTING MACHINE

[75] Inventor: Norbert Paul Bourgeois, Troyes, France

[73] Assignee: A.S.A. S.A., Roanne, France

[21] Appl. No.: 726,954

[22] Filed: Sept. 27, 1976

[30] Foreign Application Priority Data

Oct. 1, 1975 France ..... 75.30070

[51] Int. Cl.[2] ..... D04B 15/88

[52] U.S. Cl. ..... 66/151

[58] Field of Search ..... 66/151, 152, 153, 147, 66/149 R

[56] References Cited

U.S. PATENT DOCUMENTS

| | | | |
|---|---|---|---|
| 2,329,618 | 9/1943 | Ingalls | 66/151 X |
| 2,423,484 | 7/1947 | Cosgro | 66/152 X |
| 3,162,028 | 12/1964 | Egerton et al. | 66/151 |

FOREIGN PATENT DOCUMENTS

| | | |
|---|---|---|
| 1,194,326 | 6/1970 | United Kingdom. |

*Primary Examiner*—Mervin Stein
*Assistant Examiner*—Andrew M. Falik
*Attorney, Agent, or Firm*—Arnold, White & Durkee

[57] ABSTRACT

A circular knitting machine has a rotary wind up apparatus with at least two rollers mounted in a rotatable frame. Means to rotate the wind up apparatus extend within the knitted tube to act on the rollers, and preferably comprises a blade of low friction material.

5 Claims, 2 Drawing Figures

DRIVE ARRANGEMENT FOR WIND-UP APPARATUS IN A CIRCULAR KNITTING MACHINE

Figure 1:
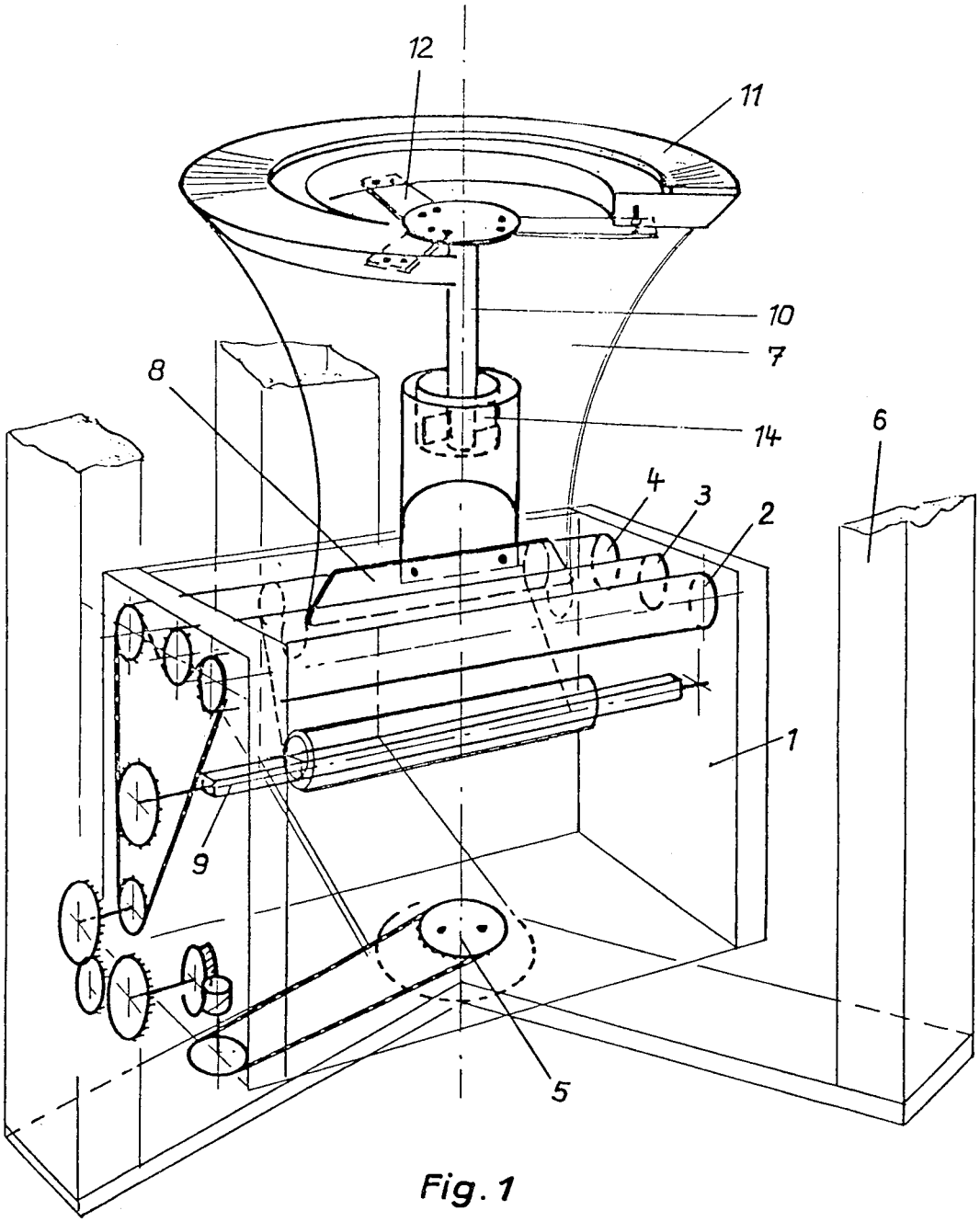

The present invention relates to a drive arrangement for a wind up apparatus in a circular knitting machine, in which the tube of knitted fabric provided by knitting elements passes over a cloth expander located upstream of the wind up apparatus.

In such a machine, it is known to use a rotary device for drawing off knitted fabric, and to drive this device synchronously with movement of the needle beds. The rotary device as a whole generally rotates about the axis of the machine, i.e., the axis of the tube of knitted fabric as drawn off. The rotary device usually comprises several draw-off rollers arranged parallel to one another along a diametral plane of the machine, the rollers being rotatably mounted on the rotary draw-off device. In use, the tube of knitted fabric is structured to its wind-up width by passing over the cloth expander. The fabric then passes between the rollers in the form of a plane web of double thickness, which is driven tangentially so as subsequently to be wound up in the lay-flat form on the rotating shaft of a wind-up machanism on the rotary device. In the majority of the known devices of this type, the rotation of the draw-off rollers results from the relative movement between the whole of the rotary draw-off device and stationary parts of the machine.

This rotary movement is controlled from the machine drive motor which also drives the needle beds. This motor, which is generally located in one of the legs of the framework, synchronously controls, via suitable transmissions, both a shaft which transmits movement to the members carrying the knitting elements and to a second shaft which transmits movement to the rotary knitted fabric draw-off device. The transmission generally comprises a set of intermediate gear-wheele controlled from the shaft of the motor, which gear-wheels engage with a large toothed wheel hereinafter referred to as the "drive wheel", which is firmly fixed to the rotary device which carries the draw-off rollers and is rotatably mounted on a base-plate fixed to the stationary framework of the machine. Most commonly, the drive wheel rotates in a bath of oil, so that a lubricant film is interposed between the wheel and is base-plate so as to reduce friction.

The knitted fabric is drawn off tangentially by the rollers and the rotation of the draw-off rollers is controlled by the rotational movement of the rotary draw-off device for example via a kinematic chain arrangement of the type described in U.S. Pat. No. 3,850,012.

The cloth expander is located above the draw-off rollers, inside the tube of knitted fabric, and brings the tube to a wind-up width which is a function of to the textile produced and the yarn employed. This expander is caused to rotate, by the knitted fabric itself, about a fixed shaft of which the axis coincides with that of the knitting elements and the drawn-off knitted tube.

The transmission of movement from the motor to the rotary wind up drive device is complicated, bulky and expensive and consumes a large amount of energy. In fact, this transmission comprises at least one drive gear-wheel which engages with an intermediate stepped gear-wheel for adjusting the speed of rotation. The intermediate gear-wheel controls a relatively long shaft (of the order of one metre in length) which at its lower end carries a gear-wheel which drives the drive wheel of the rotary wind up device. This drive wheel is a very heavy casting and in spite of the presence of a film of oil between the two surfaces, the friction between it and its base-plate is considerable.

In order to reduce this friction, it has already been proposed to mount the drive wheel on a ball bearing. However, not only does this require the provision of an additional expensive item, but it is also necessary to provide powerful braking on the shaft which joins the motor to the drive wheel, without which the inertia of the latter is such that on stopping the machine an oscillatory movement develops, which can damage certain parts of the machine.

In order to omit the drive wheel of the rotary wind-up device, it has been proposed to drive the latter by means of arms on the outside of the knitted fabric. These arms are each fixed at one end to the rotating members which carry the knitting elements, for example to the vertical needle bed, and at their other ends to the chassis of the rotary wind up device. This rigid linkage transmits rotary movement, but has the very great disadvantage of being extremely dangerous. Therefore, it is essential to enclose all the lower part of the machine in a casing, starting from the point of connection between the arms and the rotating elements. However, this casing interferes greatly with visual examination of the knitted fabric and more still with assessment of its tension, which is usually done by manually feeling the surface of the tube of knitted fabric. Some manufacturers have provided inspection windows, closed off by a transparent plastic, which facilitates visual examination but does not make it possible to assess the tension of the knitted fabric which is very important.

The present invention aims to provide a drive arrangement for a rotary wind up device which eliminates or reduces the above disadvantages.

According to the present invention there is provided a circular knitting machine having a rotary wind up apparatus including at least two rollers mounted in a rotatable frame, the machine having means to rotate the wind up apparatus, such means being located, in use, inside the knitted tube formed by the machine and acting on the two rollers.

This arrangement does not consume energy unnecessarily, it can allow stopping of the rotary device without oscillation, and it permits completely safe access to the tube of knitted fabric whilst it is being formed.

Preferably, the blade which controls the rotation of the rotary wind up device is made of a material which has a very low coefficient of friction.

Figure 2:
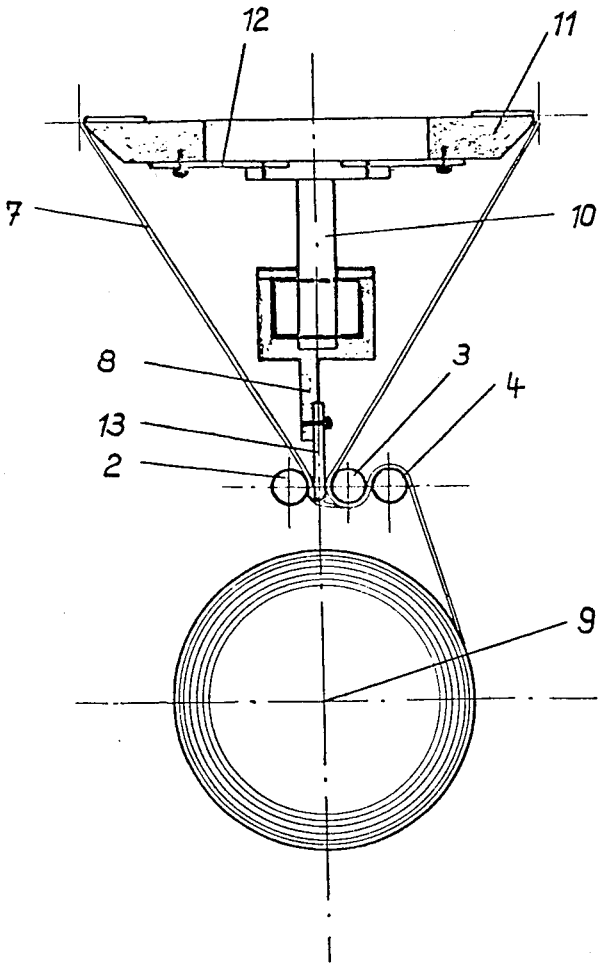

The invention will be more clearly understood from the following description which is given by way of example only with reference to the accompanying drawings, in which:

FIG. 1 is a schematic perspective view of a circular knitting machine equipped with the device according to the invention, and FIG. 2 is a schematic vertical sectional view of certain details of FIG. 1.

The circular knitting machine shown in FIG. 1 comprises a rotating assembly carrying two needle beds, of which only a horizontal needle bed 11 is shown, and a draw-off and wind-up device 1 for knitted fabric produced by the needles. The draw-off device as a whole is rotatable about the axis of the needle beds, i.e. in this case a vertical axis, and it comprises, in its upper part, three-draw-off rollers 2, 3 and 4 arranged parallel to one another and in a diametral plane of the circular knitting machine. The rotary device 1 is mounted on an axle 5 firmly fixed to a base of a stationary framework 6 of the machine. In use, it is caused to rotate about the axle 5 on two ball bearings (which are not shown), by a blade 13 which extends between two of the rollers. The blade 13 causes the whole device to rotate.

Fabric knitted by the elements in the needle beds is in the form of a tube 7 which surrounds the cloth expander 8 and is engaged, in the form of a plane double-thickness web, between the roller 2 and the central roller 3, over part of which it is wrapped before being engaged between this central roller 3 and the roller 4 (FIG. 2), from where it is wound up on a rotating shaft 9 of a conventional wind up mechanism, of which the details of construction and method of control do not fall within the scope of the present invention, and which it is thus superfluous to describe in greater detail.

The cloth expander 8, which is an elongate member perpendicular to the axis of the tube is fixed to a tube or shaft 10 joined to the horizontal needle bed 11 of the knitting machine by three leaf springs 12. The joint is rigid as far as rotational movement is concerned but, because the axis of the rotary wind up device 1 may not lie exactly along the axis of the knitting elements, the tube 10, which joins these two axes, may be at an angle to the vertical, and in the transmission of the movement from the horizontal needle bed 11 to the wind up 1 via this tube 10, the leaf springs 12 play the role of a Cardan joint and make it possible to absorb the variations in angle which may occur, and thus facilitate the rotation of the whole. On an extension of the tube 10, on the opposite face of the expander 8, is mounted the blade 13 which is inserted between the draw-off rollers 2 and 3 (FIG. 2). This blade must be very smooth so as not to damage the surface of the knitted fabric with which it is in contact. It may with advantage be produced of a mateial sold under the trademark "Delrin" but could also consist of a highly polished metal. The advantages of Derlin or of a similar plastic over a metal are a lower density, and hence a lower inertia, complete resistance to corrosion without surface treatment, and a very low coefficient of friction.

It will be appreciated that rotation of the horizontal needle bed 11 brings about the rotation of the expander 8 and blade 13. Because blade 13 extends between rollers 2 and 3 it causes rotation of the wind up device 1 as a whole about the vertical axle 5. Upon such rotation, rollers 2, 3 and 4 and shaft 9 are rotated to draw knitted fabric over the expander and wind it up.

It only requires the provision of a very small amount of energy to cause the wind up device to rotate. In spite of the low inertia of the blade 13, stopping of the knitting machine can be followed by an oscill atory movement in the control of the wind up. Any such oscilltion is avoided or reduced by means of a shock absorber 14 (FIG. 1) which can be of any known type but is preferably a hydraulic shock absorber.

I claim:

1. A circular knitting machine comprising needle beds adapted to produce a knitted tube, a cloth expander located, in use of the machine, within the knitted tube and a rotary wind up apparatus, such apparatus comprising at least two rollers mounted in a rotatable frame, said machine including means to rotate said rotary wind up apparatus, such means being adapted to act on said two rollers and being located, in use of the machine, within the knitted tube and being supported beneath the expander, said expander being supported by a shaft attached to one needle bed of the machine, and a shock absorber located between said shaft and said expander.

2. A circular knitting machine comprising needle beds adapted to produce a knitted tube, a cloth expander located, in use of the machine, within the knitted tube and a rotary wind up apparatus, such apparatus comprising at least two rollers mounted in a rotatble frame, said machine including means to rotate said rotary wind up apparatus, such means being adapted to act on said two rollers and being located, in use of the machine, within the knitted tube and being supported beneath the expander, said expander being supported by a shaft attached to one needle bed of the machine, and leaf springs connecting said shaft to said needle bed, said leaf springs allowing axial but not rotational movement of said shaft relative to said needle bed.

3. A circular knitting machine as claimed in claim 2 wherein said means comprises a blade.

4. A circular knitting machine as claimed in claim 2 wherein said blade is of a material of very low coefficient of friction.

5. A circular knitting machine as claimed in claim 2 including a shock absorber located between said shaft and said expander.

* * * * *